United States Patent [19]

Delaney

[11] Patent Number: 4,752,380

[45] Date of Patent: Jun. 21, 1988

[54] ARSENIC REMOVAL FROM SHALE OIL BY CHLORIDE ADDITION

[75] Inventor: Dennis D. Delaney, Yorba Linda, Calif.

[73] Assignee: Union Oil Company of California, Los Angeles, Calif.

[21] Appl. No.: 910,512

[22] Filed: Sep. 23, 1986

[51] Int. Cl.[4] ..... C10G 17/00

[52] U.S. Cl. ..... 208/252; 208/251 R; 208/280; 208/265

[58] Field of Search ..... 208/252, 251 R, 280

[56] References Cited

U.S. PATENT DOCUMENTS

| | | | |
|---|---|---|---|
| 2,778,779 | 1/1957 | Donaldson | 208/295 |
| 2,943,048 | 6/1960 | Rust et al. | 208/252 |
| 2,951,804 | 9/1960 | Juliard | 208/91 |
| 2,971,905 | 2/1961 | Bieber et al. | 208/252 |
| 3,036,968 | 5/1962 | Gatsis | 208/251 R |
| 3,095,368 | 6/1963 | Bieber et al. | 208/252 |
| 3,180,706 | 4/1965 | Erickson | 208/252 |
| 3,457,164 | 7/1969 | Gatsis | 208/252 |
| 3,483,117 | 12/1969 | Gleim | 208/252 |
| 3,483,118 | 12/1969 | Gleim et al. | 208/252 |
| 3,677,932 | 7/1972 | Hardesly et al. | 208/253 |
| 3,679,577 | 7/1972 | Wantland | 208/253 |
| 3,893,912 | 7/1975 | Zimmerman | 208/253 |
| 3,933,624 | 1/1976 | Myers | 208/253 |
| 4,039,432 | 8/1977 | Michlmayr | 208/253 |
| 4,046,674 | 9/1977 | Young | 208/253 |
| 4,075,085 | 2/1978 | Young | 208/253 |
| 4,424,119 | 1/1984 | Audeh | 208/251 R |
| 4,424,120 | 1/1984 | Audeh | 208/253 |
| 4,428,862 | 1/1984 | Ward et al. | 502/77 |
| 4,430,206 | 2/1984 | Rankel | 208/251 R |
| 4,446,006 | 5/1984 | Albertson | 208/253 |
| 4,464,251 | 8/1984 | Kukes et al. | 208/251 R |
| 4,552,646 | 11/1985 | Stapp | 208/253 |
| 4,601,816 | 7/1986 | Rankel | 208/253 |

FOREIGN PATENT DOCUMENTS

| | | | |
|---|---|---|---|
| 550713 | 12/1957 | Canada | 208/252 |
| 1642497 | 6/1962 | Canada | 208/252 |
| 2770 | 2/1965 | Japan | 208/252 |
| 18784 | 1/1982 | Japan | 208/253 |

OTHER PUBLICATIONS

"The Role of Trace Metals in Petroleum", Chapter 2, p. 31, The Nature of Metals in Petroleum by R. H. Filby. CRC, Handbook of Chemistry and Physics, 60th Ed., 1979–1980, p. (B–4).

Fish, R. H. and Brinckman, F. E., "Organometallic Geochemistry, Isolation and Identification of Organoarsenic and Inorganic Arsenic Compounds from Green River Formation Oil Shale," *Symposium on Geochemistry and Chemistry of Oil Shale,* presented before the divisions of Fuel Chemistry, Geochemistry, and Petroleum Chemistry, Inc., pp. 177–180, American Chemical Society Seattle Meeting, Mar. 20–25, 1983.

Fish, R. H., Brinkman, F. E. and Jewett, K. L., "Fingerprinting Inorganic Arsenic and Organoarsenic Compounds in in Situ Oil Shale Retort and Process Waters Using a Liquid Chromatograph Coupled with an Atomic Absorption Spectrometer as a Detector," *Environ. Sci. Technol.,* vol. 16, No. 3, pp. 174–179 (1982).

Fenton, D. M., Henning, H. and Richardson, R. L., "The Chemistry of Shale Oil and Its Refined Products," *ACS Symposium Series,* No. 163, Oil Shale, Tar Sands and Related Materials, pp. 315–325 (1981).

*Primary Examiner*—Helen M. S. Sneed
*Assistant Examiner*—Helane Myers
*Attorney, Agent, or Firm*—Dean Sandford; Gregory F. Wirzbicki; Alan H. Thompson

[57] ABSTRACT

Arsenic is removed from shale oil by the addition of acidic chloride compounds.

28 Claims, No Drawings

ARSENIC REMOVAL FROM SHALE OIL BY CHLORIDE ADDITION

BACKGROUND OF THE INVENTION

1. Field of the Invention

This invention relates to the removal of arsenic from shale oils.

2. Description of the Prior Art

Vast deposits of oil shale, sedimentary marlstone, are known to exist in several areas of the world. Such deposits are found in the United States, with the more commercially important materials located in the states of Colorado, Utah and Wyoming. The geological unit known as the Green River Formation in those states contains oil shale having up to about 85–100 percent by weight of kerogen—a three-dimensional polymer that is insoluble in conventional organic solvents. Upon heating the shale ("retorting"), kerogen decomposes to produce crude shale oil vapors, which can be condensed into a synthetic crude oil and subsequently introduced into a refinery for conversion to valuable fuels, lubricants and other products.

A number of retorting processes are known, generally classified in two categories: "in situ", wherein shale is heated in chambers formed underground without removing a significant portion of the rock material, and "above ground", wherein shale is mined by conventional methods and transported to a pyrolysis device for heating. The various processes each accomplish separation of solid and liquid retort products, using techniques which are specially designed for the particular process.

One successful above ground retorting process is shown in U.S. Pat. No. 3,361,644 to Deering, which patent is incorporated herein by reference. In this process, oil shale is fed upwardly through a vertical retort by means of a reciprocating piston. The upwardly moving oil shale continuously exchanges heat with the downwardly flowing high-specific-heat, recycle gas introduced into the top of the retort at about 1050° F. In the upper section of the retort (the pyrolysis zone), the hot recycle gas educes hydrogen and hydrocarbonaceous vapors from the oil shale. In the lower section (the preheating zone), the oil shale is preheated to pyrolysis temperatures by exchanging heat with the mixture of recycle gas and educed hydrocarbonaceous vapors plus hydrogen. Most of the heavier hydrocarbons condense in this lower section and are collected at the bottom of the retort as a product oil. The uncondensed gas is then passed through external condensing or demisting means to obtain additional product oil. The remaining gases are then utilized as a product gas, a recycle gas as hereinbefore described, and as a fuel gas to heat the recycle gas to the previously specified 1050° F. temperature.

In all known oil shale retorting processes, arsenic components of the shale either sublime to or are pyrolyzed into vaporish arsenic-containing components. As a result, arsenic in various forms collects with the educed hydrocarbonaceous vapors and condenses with the higher molecular weight hydrocarbons in the preheating zone or, in some processes, in a condenser situated outside of the retorting vessel. When oil shale from the Green River Formation is retorted, the concentration of arsenic in the produced crude shale oil is usually in the range from about 25 to about 100 parts per million by weight (ppmw).

Shale oil can be refined to produce valuable products, lubricants and the like, using similar methods to those known for petroleum processing, such as catalytic cracking, hydrotreating, hydrocracking, and others. Problems arise, however, due to irreversible poisoning of expensive catalysts during shale oil processing. This poisoning is caused by the arsenic in the shale oil, which is generally present in a different form and in a far greater proportion than ordinary petroleum feeds.

In addition to causing processing difficulties, the arsenic content limits the usefulness of shale oil even in its unrefined state, since burning high arsenic-containing fuels results in unacceptable pollution. For these reasons, it is desirable to reduce the amount of arsenic present in shale oils to the lowest possible level. Young, in U.S. Pat. Nos. 4,046,674 and 4,075,085, describes methods to remove arsenic utilizing a solid absorbent containing nickel and molybdenum on refractory oxides ('674) and oil-soluble nickel, cobalt or copper-containing additives ('085). Furthermore, Albertson, in U.S. Pat. No. 4,446,006 describes a process for removing arsenic by adding elemental sulfur or aqueous sodium hydrogen phosphate to a shale oil.

A need remains for a simple, inexpensive method for reducrng the arsenic content of shale oils. Accordingly, it is an object of the present invention to provide a method for removing arsenic from shale oil or fractions thereof. A further object is to remove arsenic upstream of solid arsenic-removing absorbents or hydroprocessing catalysts deactivated by arsenic so as to extend their lives. These and other objects of the invention will become more apparent in view of the following description of the invention.

SUMMARY OF THE INVENTION

Briefly, the invention provides a method for removing arsenic from shale oils by contacting arsenic-containing shale oils under reaction conditions with one or more acidic chloride materials to convert a substantial proportion of the arsenic to a water-extractable form. In one embodiment, an acidic chlorine material, such as organic acid chlorides and inorganic chlorides of Group II through Group VI of the Periodic Table, is added to the shale oil and the resultant admixture subjected to reaction conditions including an elevated temperature and pressure to convert at least some of the arsenic components in the shale oil to arsenic components more easily extractable by water. The converted arsenic components are then separated by water extraction or water leaching from a product shale oil of reduced arsenic content. In a preferred embodiment of the invention, hydrochloric acid is added to a substantially anhydrous deashed shale oil, and the resultant mixture subjected to a temperature from about 150° F. to about 400° F. for sufficient residence time to convert at least some of the water-insoluble arsenic components in the admixture to water-soluble arsenic components that are subsequently separated by water extraction from a product shale oil of reduced arsenic content in a downstream deashing unit.

DETAILED DESCRIPTION OF THE INVENTION

Shale oils which can be treated by the method of the invention include those obtained by "in situ" or "above ground" retorting, as well as those produced by chemical extraction techniques, containing at least about 2 ppmw of arsenic. The term "shale oils" is meant to include not only crude shale oils obtained directly from the rock material, i.e., "raw" shale oil, but also the fractions and products therefrom, which still contain more than 2 ppmw of arsenic. In general, the feedstock is a full boiling range shale oil crude or fraction thereof, which may have been treated to remove solid constituents, e.g., deashing, preferably, however, the feedstock has not been catalytically hydroprocessed. processed.

While not being bound to any particular theory, it is considered likely that arsenic is present in raw oil shale and raw shale oil mostly as alkaline earth metal arsenates and arsenites and/or as arsenic oxides. During retorting, reactions occur (such as the Bechamp reaction between aromatic amines or phenols and arsenic oxide to form p-amino or p-hydroxyphenylarsonic acids) which cause organoarsenic compounds to form. In addition, a major amount of the arsenic oxides sublimes or volatilizes and dissolves in the condensed shale oil. A portion of the sublimed or volatile arsenic can also be entrained in the shale oil as very small particles, many of which could not be separated by filtration or other ordinary techniques.

In view of the foregoing, the term "arsenic" is considered as including all forms thereof, i.e., both the element and organic and inorganic compounds, in which it is present in shale oil. Also, it should be noted that all feedstock and product oil arsenic concentrations will hereinafter be calculated by weight as elemental arsenic, expressed as parts per million by weight (ppmw).

The removal of arsenic from shale oils is carried out using a method which generally comprises treating the shale oil with one or more acidic chloride materials and separating a product shale oil of reduced arsenic content from an aqueous liquid containing dissolved arsenic. Typical shale oils have an initial arsenic content greater than about 20 ppmw, usually from about 25 to about 100 ppmw, and often above 50 ppmw. The treatment gives improved results with elevated temperatures and usually will be conducted at such pressures as will prevent boiling of the acidic chloride/shale oil admixture at a desired temperature. Normally pressures up to about 2,500 p.s.i.g. pressure and typically from about 25 p.s.i.g. to about 500 p.s.i.g., are employed during the course of the treatment. After treatment of the shale oil by the method of the invention, the product shale oil has a reduced arsenic content, usually reduced to less than about 30 ppmw, and ordinarily in the range from about 1 to about 25 ppmw. Thus, the treatment provides at least a 10 percent, preferably at least a 25 percent, and most preferably at least a 40 percent reduction in the arsenic content of the shale oil.

It is highly preferred that the shale oil compositions treated by the method of the invention be substantially anhydrous. A "substantially anhydrous" shale oil or shale oil/acidic chloride admixture as used herein refers to shale oil compositions containing up to that amount of water soluble in the shale oil or shale oil/acidic chloride admixture at atmospheric conditions. Ordinarily, the amount of water soluble at atmospheric conditions in typical shale oils or admixtures is less than 5, usually less than 1, and most usually less than 0.1 weight percent.

That portion of the total arsenic which is present in shale oils as arsenic (III) oxide is soluble in water (approximately 10 weight percent in boiling water); the portion present in shale oil as arsenic (V) oxide is even more soluble in water (approximately 75 weight percent in boiling water). For this reason, treatment of a shale oil by contacting with only water will remove a portion of the arsenic, the exact amount removed depending upon relative solubilities, ratio of oil and water volumes, number of contact stages, efficiency of operation, and the like. However, the method of the invention provides for removal from the shale oil of the organically-bound arsenic components having substantially lower solubility in boiling water than the arsenic oxides. The organically-bound components are essentially water-insoluble at the conditions of treatment of the invention. The method is particularly effective for treating oxygen-containing organically-bound arsenic. It is believed that the method requires treatment under conditions breaking the molecular bonds in such organically-bound arsenic. For example, if it is assumed that phenylarsonic acids are present from the previously mentioned Bechamp reaction, arsenic could be recovered following a hydrolysis-type reaction to reform arsenic oxide.

Efficient arsenic removal can be accomplished by converting the organically-bound arsenic components into a form which is more soluble in aqueous media than in the shale oil. Such conversion results from treatment of the shale oil with an acidic chloride that reacts with the arsenic components to form product arsenic components more easily extractable by water. The acidic chloride material is usually selected from the group consisti of hydrogen-containing acid chlorides and organic or inorganic chloride-containing salts, which, when dissolved in water, have a pH of less than about 7, and acids containing chlorides. Acidic chloride materials contemplated for use herein include organic acid chlorides and inorganic chlorides of Group IIB, Group IIA, Group IVA, Group VA and Group VIA of the Periodic Table. Preferred acidic chloride materials include aluminum chloride, sulfur monochloride, bismuth chloride, phosphorus trichloride, phosphorus pentachloride, potassium chloride, zinc chloride and most preferably hydrogen chloride or hydrochloric acid. After reaction of the acidic chloride and arsenic components, the product arsenic components can be extracted from the product shale oil by adding an aqueous solution to the product mixture that at least a two phase (water and product shale oil) system is produced. In this manner, the product shale oil can also be separated from the product arsenic components that contain organically-bound arsenic molecules that hydrolyze or react by other mechanisms. Ordinarily the aqueous solution and product shale oil are mixed in a water-to-shale oil weight ratio of greater than about 0.01:1 and typically in the range from about 0.05:1 to about 1:1.

Treatment of shale oils by the method of this invention comprises admixing the arsenic-containing shale oil with a sufficient amount of the acidic chloride material to convert the desired amount of arsenic to water-soluble or extractable forms. The acidic chloride is typically added to the shale oil in a form providing extensive contact of the reacting species in the shale oil/acidic chloride admixture. Ordinarily the concentration of the acidic chloride in the shale oil is more than about 5 ppmw, and typically in the range from about 50 ppmw to about 5,000 ppmw. In one embodiment, it is preferred that the acidic chloride material be added to the shale oil in a form resulting in an acidic chloride/shale oil admixture that is a substantially anhydrous shale oil composition prior to and during the reaction, e.g., the contacting or admixing of the acidic chloride material and shale oil occurring at substantially anhydrous reaction conditions.

The method can be conducted either in batch or continuous type of operation. For batch operation, shale oil and acidic chloride material are intimately mixed in a suitable vessel, mixing is discontinued, and the resulting mixture is typically mixed with water and separated into a product shale oil phase and an aqueous phase containing the removed arsenic. In a continuous operation, shale oil and acidic chloride material are passed concurrently or countercurrently into a reactor, which can be fitted with mixing devices, charged with packing material (such as Raschig small rings, ceramic balls, and the like), and/or provided with fractionating means such as bubble plates, sieve plates, etc., and therefrom mixed with water and passed as a mixture into a phase separating means, such as a deashing unit, for recovery of product shale oil and an aqueous effluent.

As previously noted, elevated temperatures facilitate arsenic removal from the shale oil, probably due to the accelerated decomposition of organoarsenic compounds at higher temperatures. A temperature of at least about 100° F. is desired for the process of the invention and a maximum useful temperature is normally below the point at which significant thermal cracking of the shale oil occurs. It would not normally be necessary to use temperatures above about 500° F. Very efficient arsenic removal has been observed in the range from about 250° to about 350° F., temperatures which are probably sufficient for breaking the chemical bonds to release organic-bound arsenic. The preferred temperature range, therefore is from about 150° to about 400° F.

The choice of acidic chloride materials also affects subsequent operations in the method. Although all the contemplated acidic chlorides convert the arsenic in the shale feedstock to water soluble arsenic components, some acidic chlorides may also form solid particulates which require separation by filtration, centrifugation or similar techniques, including the separation means in a deashing unit.

If a deashing unit is used after reaction, the retorted or raw shale oil now containing water-soluble arsenic components and water-insoluble solid particulates, is typically mixed with about 5 to about 90 weight percent of water. The solids are partitioned (separated) into the water phase and water soluble arsenic components are also removed from the shale oil by dissolution into the water phase. The resulting shale oil is termed "deashed" shale oil For example, a retorted shale oil containing about 50–75 ppmw of arsenic is mixed with about 10 percent water in a deashing unit and the resulting "deashed" shale oil contains about 30–35 ppmw of arsenic.

In one embodiment of the invention, the acidic chloride material is admixed with a substantially anhydrous shale oil upstream of a deashing unit. In another embodiment, the acidic chloride may be admixed with the shale oil/water emulsion in the deashing unit. In a preferred embodiment, the acidic chloride is admixed with a substantially anhydrous, and at least partially deashed, shale oil between deashing units in a multiple train of deashing units. (As used herein, a partially deashed shale oil has passed through at least one deashing unit.) It is most highly preferred to admix the acidic chloride material with a deashed shale oil initially containing essentially no arsenic components found in a water-extractable form. Typical reaction conditions in a deasher for the shale oil/acidic chloride admixture include an elevated pressure from about 50 p.s.i.g. to about 150 and a temperature in the range from about 150° to about 350° F.

The processing by the invention of shale oil compositions that are not substantially anhydrous may, in some cases, detrimentally affect the removal of arsenic. It is highly preferred that non-anhydrous shale oils be pretreated for water removal, as by distillation, electrostatic separation, decantation, deashing and the like.

In a preferred embodiment of the invention, the acidic chloride material is reacted with the arsenic components in a shale oil before, during and/or after the deashing step in an overall integrated process comprising treating raw shale oil for ash and arsenic removal and hydroprocessing the deashed and dearsenited shale oil. The integrated process typically includes deashing a retorted shale oil followed by removing arsenic from the deashed shale oil by contacting the deashed shale oil with a solid catalytic absorbent, such as the nickel and molybdenum-containing absorbent disclosed in U.S. Pat. No. 4,046,674, the disclosure of which is incorporated by reference herein in its entirety. After both ash and arsenic removal from the shale oil, the integrated process further includes the step of catalytically hydroprocessing the deashed, dearsenited shale oil feed by hydroprocesses that produce valuable fuels, lubricants and other shale oil products. For instance, the deashed, dearsenited shale oil feed may be contacted with a Group VIB/Group VIII metal-containing catalyst under desulfurizing and/or denitrogenating conditions to produce shale oil products of lower sulfur and/or nitrogen content. In addition to sulfur and nitrogen removal the shale oil feedstock may be catalytically hydrocracked, and more particularly, be catalytically hydrodewaxed to produce shale oil products havin9 lower pour points than the feedstock, as for example, in the simultaneous hydrotreating and hydrodewaxing process disclosed in U.S. Pat. No. 4,428,862, the disclosure of which is incorporated by reference herein in its entirety. An advantage provided by removing arsenic from the shale oil by the method of the invention is the resultant lower content of arsenic contacting downstream catalysts. Thus, the lives of (1) the arsenic-removing catalytic absorbent employed subsequent to deashing the shale oil feedstock and (2) the downstream hydroprocessing catalysts are extended.

The invention is further illustrated by the following example which is illustrative of specific modes of practicing the invention and is not intended as limiting the scope of the appended claims.

EXAMPLE

The removal of arsenic from a deashed shale oil containing 31 ppmw of arsenic is illustrated by adding oxidizing agents, which are shown in the following TABLE 1, to the shale oil and and subjecting the resultant admixture to an elevated temperature and pressure.

In treatments 2 and 3, the acidic chloride materials shown in TABLE 1 are added to 75 grams of the deashed shale oil in a glass-lined autoclave (equipped with a stirrer) in a concentration of 1,000 ppmw. The mixtures are each subjected to a nitrogen pressure of 400 p.s.i.g. and gradually heated to a temperature of 338° F. and each held for 2 hours. After being cooled to room temperature, the treated mixtures are each mixed with an equal weight of water and stirred for 30 seconds at high speed. After separation from the water, the treated mixtures are analyzed for arsenic content. Run number 1 is conducted in the same manner as runs 2 and 3, except no acidic chloride material is added to the deashed shale oil. The data is summarized in TABLE 1.

TABLE 1

| | Acidic Chloride | Arsenic in treated shale oil (ppmw) | Percent Arsenic removal |
|---|---|---|---|
| 1 | none | 31 | 0 |
| 2 | Hydrochloric acid (HCl) conc. | 8.7 | 82 |
| 3 | Phosphorus trichloride ($PCl_3$) | 5.5 | 86 |

While particular embodiments of the invention have been described, it will be understood, of course, that the invention is not limited thereto since many obvious modifications can be made, and it is intended to include within this invention any such modifications as will fall within the scope of the appended claims.

I claim:

1. A method for removing arsenic components from a shale oil-derived hydrocarbon feedstock containing water-insoluble arsenic components, said method comprising the following steps: (1) contacting said feedstock with one or more acidic chloride materials under conditions including a temperature from about 100° F. to about 500° F. to convert at least some of said water-insoluble arsenic components to one or more water-soluble forms of arsenic components, and (2) dissolving said water-soluble forms of arsenic components obtained from step (1) in water to separate said water-soluble forms from a product shale oil of reduced arsenic content.

2. The method defined in claim 1 wherein said acidic chloride material is selected from the group consisting of hydrogen-containing chlorides and inorganic chlorides containing elements of Group IIB, Group IIIA, Group IVA, Group VA and Group VIA of the Periodic Table.

3. The method defined in claim 1 wherein said contacting occurs at substantially anhydrous conditions including a temperature in the range from about 150° to about 400° F.

4. The method defined in claim 1 wherein said shale oil is at least partially deashed.

5. The method defined in claim 1 wherein said acidic chloride material comprises hydrochloric acid.

6. The method defined in claim 1 wherein said acidic chloride material comprises an inorganic chloride-containing salt selected from the group consisting of aluminum chloride, sulfur monochloride, bismuth chloride, phosphorus trichloride, phosphorus pentachloride, potassium chloride, and zinc chloride.

7. The method defined in claim 1 wherein said feedstock is a substantially anhydrous shale oil containing about 25 to about 100 ppmw of arsenic and said product shale oil contains about 1 to about 25 ppmw of arsenic.

8. The method defined in claim 1 wherein said feedstock contains oxygen and some arsenic in a form not extractable by water.

9. The method defined in claim 1 wherein said acidic chloride material comprises an organic acid chloride material.

10. A method for removing arsenic from a retorted shale oil which comprises the following steps: (1) admixing a shale oil containing at least some water-insoluble arsenic components with one or more acidic chloride materials under conditions including a temperature from about 150° to about 400° F. to convert at least a portion of said water-insoluble arsenic components to a water-soluble form, and (2) dissolving said water-soluble arsenic components obtained from step (1) in water to separate said water-soluble arsenic components from a product shale oil of reduced arsenic content, said acidic chloride materials selected from the group consisting of hydrogen-containing chlorides and organic or inorganic chlorides containing elements of Group IIB, Group IIIA, Group IVA, Group VA and Group VIA of the Periodic Table.

11. The method defined in claim 10 wherein said shale oil is at least partially deashed.

12. The method defined in claim 10 wherein said shale oil is substantially anhydrous and contains about 25 to about 100 ppmw of arsenic.

13. The method defined in claim 10 wherein said product shale oil contains about 1 to about 25 ppmw of arsenic.

14. The method defined in claim 10 wherein said acidic chloride material comprises hydrochloric acid.

15. The method defined in claim 10 wherein said acidic chloride material comprises an inorganic chloride-containing salt selected from the group consisting of aluminum chloride, sulfur monochloride, bismuth chloride, phosphorus trichloride, phosphorus pentachloride, potassium chloride, and zinc chloride.

16. The method defined in claim 10 wherein said acidic chloride material is an organic acid chloride material.

17. The method defined in claim 10 wherein said admixing occurs at substantially anhydrous conditions.

18. A method for removing arsenic from a shale oil-derived hydrocarbon feedstock comprising the following steps: (1) admixing one or more acidic chloride materials with said feedstock under conditions including a temperature from about 100° F. to about 500° F. to Convert water-insoluble arsenic components in said feedstock to water soluble arsenic components, (2) separating a first product shale oil of reduced arsenic content from said water-soluble arsenic components by dissolving said water-soluble arsenic components obtained from step (1) in water, and (3) then contacting said first product shale oil, in the presence of hydrogen, with a catalytic absorbent under arsenic-removing conditions to produce a second product shale oil containing less arsenic components than said first product shale oil.

19. The method defined in claim 18 wherein said solid particulate material comprises a Group VIB or Group VIII metal component supported on a porous refractory oxide.

20. The method defined in claim 18 wherein said acidic chloride material is selected from the group consisting of inorganic chlorides containing elements of Group IIB, Group IIIA, Group IVA, Group VA and Group VIA of the Periodic Table.

21. The method defined in claim 18 wherein said feedstock is at least partially deashed.

22. The method defined in claim 18 wherein said feedstock contains about 25 to about 100 ppmw of arsenic.

23. The method defined in claim 18 wherein said first product shale oil contains about 1 to about 25 ppmw of arsenic.

24. The method defined in claim 18 wherein said acidic chloride material comprises hydrochloric acid.

25. The method defined in claim 18 wherein said acidic chloride material comprises a chloride-containing salt selected from the group consisting of aluminum chloride, sulfur monochloride, bismuth chloride, phosphorus trichloride, phosphorus pentachloride, potassium chloride, and zinc chloride.

26. The method defined in claim 18 wherein said acidic chloride material is an organic acid chloride.

27. The method defined in claim 18 wherein said second product shale oil contains less than 1 ppmw of arsenic.

28. The method defined in claim 21 wherein said shale oil and said first product shale oil and said second product shale oil contain nitrogen, and after said step (3) a hydrotreating catalyst is contacting with said second product shale oil under hydrotreating conditions to produce a third product shale oil of reduced nitrogen content as compared to said second product shale oil.

* * * * *